US009610207B1

(12) United States Patent
Fort

(10) Patent No.: US 9,610,207 B1
(45) Date of Patent: Apr. 4, 2017

(54) MEMORIAL URN

(71) Applicant: Marc A Fort, Slippery Rock, PA (US)

(72) Inventor: Marc A Fort, Slippery Rock, PA (US)

( * ) Notice: Subject to any disclaimer, the term of this patent is extended or adjusted under 35 U.S.C. 154(b) by 0 days.

(21) Appl. No.: 15/092,525

(22) Filed: Apr. 6, 2016

(51) Int. Cl.
*A61G 17/08* (2006.01)
*E04H 13/00* (2006.01)

(52) U.S. Cl.
CPC ..... *A61G 17/08* (2013.01); *E04H 13/008* (2013.01)

(58) Field of Classification Search
CPC .... A61G 17/08; E04H 13/003; E04H 13/008; A47G 1/0616
USPC ..... 27/1; 52/103–104; 40/124.5, 722; 211/85.27
See application file for complete search history.

(56) References Cited

U.S. PATENT DOCUMENTS 4,222,189 A * 9/1980 Kamei ..... A44C 3/004 27/1
6,463,703 B1 * 10/2002 Mattis ..... E04H 13/003 52/103
6,665,916 B1 * 12/2003 Santorello ..... A61G 17/08 27/1
6,904,721 B1 * 6/2005 Forbes ..... E04H 13/008 52/103
7,082,653 B1 * 8/2006 Sueppel ..... A47G 1/0616 27/1
7,191,499 B2 * 3/2007 Davis ..... A61G 17/08 27/1
7,861,385 B1 * 1/2011 Meyer ..... A61G 17/08 27/1
8,336,174 B1 * 12/2012 Johnson ..... A61G 17/007 27/1
8,341,812 B2 * 1/2013 Kocir ..... A61G 17/08 27/1
8,935,837 B2 * 1/2015 Jairala, Jr. ..... A61G 17/08 27/1
2005/0144821 A1 * 7/2005 Griesemer ..... A47G 1/14 40/546
2013/0212847 A1 * 8/2013 Gee ..... A61G 17/08 27/1
2014/0259983 A1 * 9/2014 Camp, Jr. ..... E04H 13/003 52/103

* cited by examiner

*Primary Examiner* — William Miller
(74) *Attorney, Agent, or Firm* — Richard K Thomson

(57) ABSTRACT

A memorial urn is composed of a first external retainer bearing an image which reminds the urn owner of her/his loved one, and a second ash-containing vessel that can be removably secured with a complementarily shaped opening in the flat rear surface of the retainer. The ash-containing vessel is shaped as or, alternatively, has a religious symbol etched/painted thereon, of the urn owner's choosing.

8 Claims, 8 Drawing Sheets

MEMORIAL URN

BACKGROUND AND SUMMARY OF THE INVENTION

The present invention is directed to an urn for retention of the ashes of a loved one. More particularly, the present invention is directed to a memorial urn which features an external configuration that bears a resemblance of the loved one or some aspect of her/his life.

Currently, ash-retaining urns are typically simply jars, vases, or the like, suitable merely for display upon a shelf or mantle. It is among the objects of the present invention to configure the ash-retaining vessel with an exterior forward portion that has, for example, the facial features of the departed, and a flat rear surface which permits the memorial urn of the present invention to be suspended on a wall a headstone, or the like, if desired.

With the advent of 3-D printing, the ability to fashion articles in general, and containers in particular, has been greatly enhanced. Accordingly, it is among the objects of the present invention to allow an external retainer of an ash-containing urn to be fashioned into a featured reminder of a loved one. While it is within the capability of the present invention to encompass the possibility that the loved one is an animal or pet, it is the primary intention that the external retainer be fashioned as a visage of a departed loved one, i.e., the facial resemblance of a person. It is preferred the facial resemblance would be from just behind the ears forward and from the neck above. The actual ashes of the departed will be contained within a sealed, removable vessel that is configured as, or bears the image of, a religious article of choice of the owner of the memorial urn, the removable vessel will snap into a recess in the rear portion of the external retainer in a manner such that its outermost surface occupies a plane that does not extend beyond the outermost surface of the external retainer. The convenience of the removability of the ash-containing urn allows the owner to experience a closeness with the departed at times of their choosing such as birthdays, anniversaries, holidays, etc, by removing and holding/sleeping with the ash-containing vessel.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
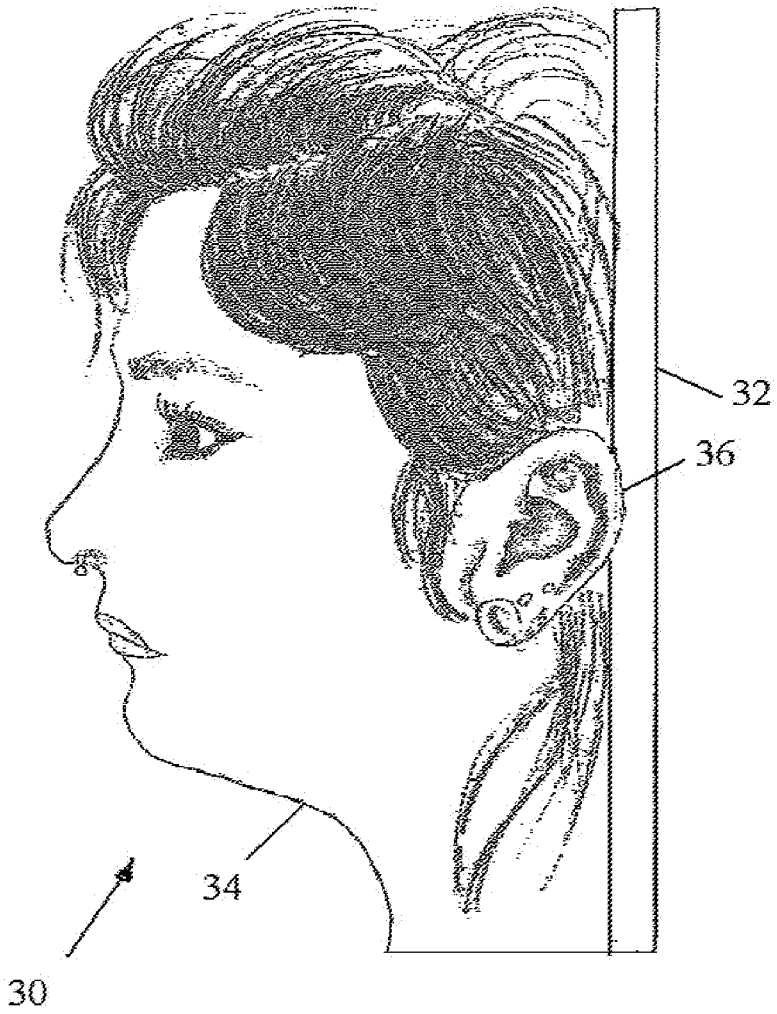
FIG. 1 is a side view of a particular configuration of an external retainer of the memorial urn of the present invention.

A first embodiment of the memorial urn of the present invention is depicted in FIGS. 1-7 generally at 20. Memorial urn 20 comprises two principle parts: first external retainer 30 which is a featured reminder of the loved one the urn memorializes; and a second ash-containing vessel 40 that will typically have, or be shaped as a religious symbol. While it is within the scope of the present invention for the "loved one" to be a pet and the "featured reminder" to be any article that reflects some aspect of the loved one's life, it is primarily intended that the loved one be a friend, family member, or spouse and that the featured reminder be a 3-D depiction of the loved one's face. This will not be a full bust or head of the loved one but as seen in FIG. 1, a partial forward facial image 34 from just behind the ears 36 forward. Software exists to permit a 3-D printer to formulate first external retainer 30 from pictures, drawings, and the like. Such software includes "Face Gen" available from Singular Inversions Inc., Toronto, Canada. Other similar commercially available software may be used, as well. Restricting the external retainer 30 to a portion of the loved one's facial resemblance allows the rear surface portion 32 to be flat so that memorial urn 20 may be mounted on a wall, a headstone, or the like. In addition, flat surface portion 32 provides a prime location for allowing a recess to be integrally molded within first external retainer 30. While it would be possible to create the entire external retainer 30 as a hollow cavity into which the loved-one's ashes are kept, it is preferred that a second separable ash-containing vessel 40 be insertable into a complementarily formed recess in the first external retainer portion 30. This will permit the ash-containing vessel 40 to be removed and closely held at times the owner feels a need to be close to his departed loved one on, say, birthdays, anniversaries or holidays.

Figure 2:
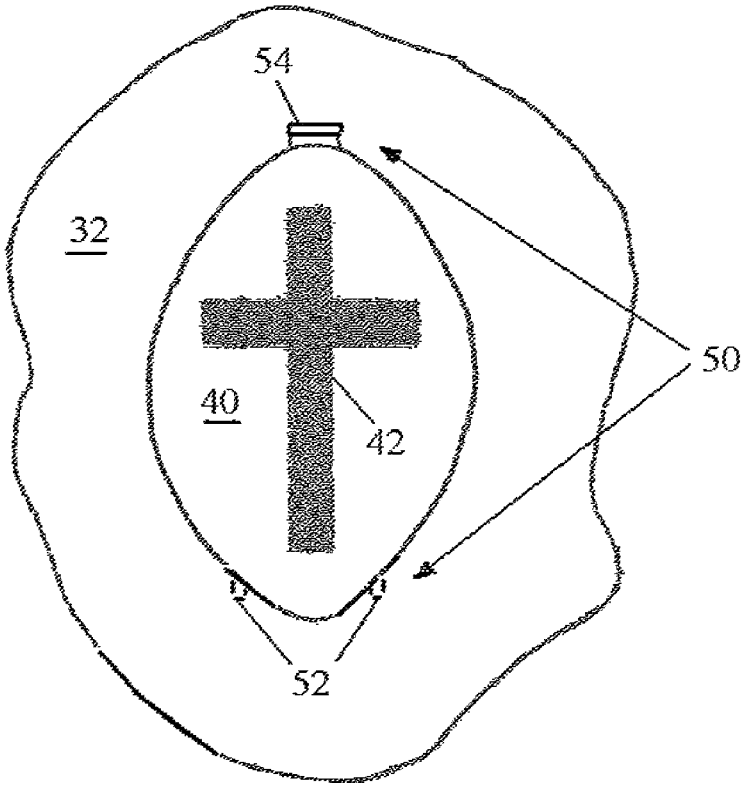
FIG. 2 is a rear view of the memorial urn of the present invention depicting an egg-shaped ash-retaining vessel snapped into the back of a external retainer bearing a first configuration of religious symbol.

While a variety of attachment means would be suitable to secure second ash-containing vessel 40 in the recess in first external retainer 30, one preferred means mimics the retention of a battery cover in the back of a TV remote control. As depicted in FIG. 2, attachment means 50 includes at least one (and preferably two) extending finger(s) 52 and a spring finger 54 which may be depressed to enable removal of ash-containing vessel 40 from a complementarily shaped recess in the rear surface portion 32 of first external retainer 30. The recess into which vessel 40 fits has a lip extending about the periphery of its opening. Extending fingers 52 and spring finger 54 engage behind the lip and retain the vessel 40 in the opening in first external retainer 30.

Figure 8A:
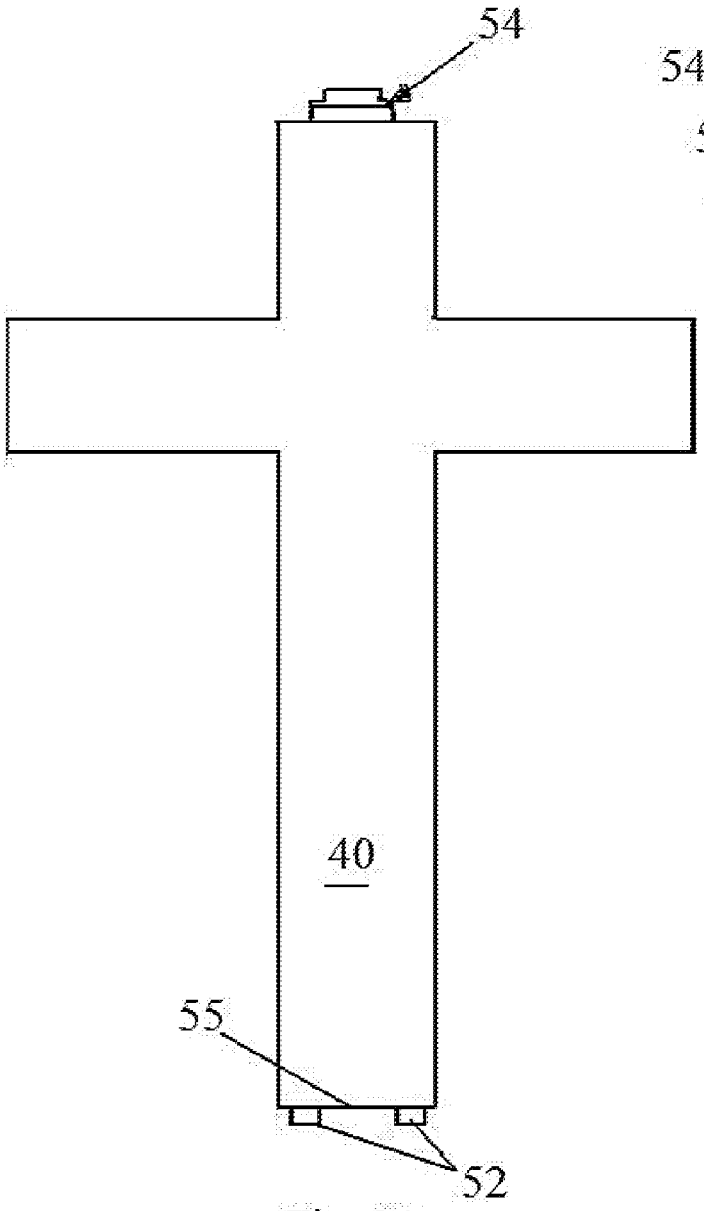
FIG. 8A is a front view of an ash-containing vessel configured as a cross.
Figure 8B:
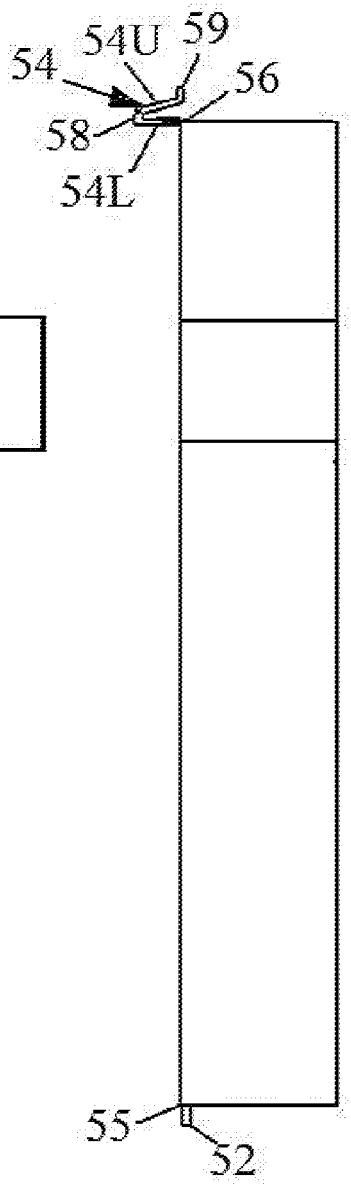
FIG. 8B is a side view of the ash-containing vessel of FIG. 8A.
Figure 8C:
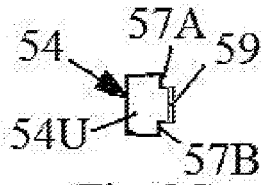
FIG. 8C is a detailed top view of the spring finger shown in FIG. 8B.

Attachment means 50 is more distinctly shown in FIGS. 8A-8C. In this embodiment, second ash-containing vessel 40 is configured as a cross. A pair of extending fingers 52 are dependent from a lower front edge portion 55 of vessel 40. A spring finger 54 protrudes outwardly from an upper front edge portion 56. Spring finger 54 is a v-shaped element with a living hinge 58 at the junction between lower leg 54L and upper leg 54U. Operating finger 59 extends upwardly from the upper leg 54U of v-shaped element. A pair of laterally extending surfaces 57A and 57B engage behind the circumferential lip of the opening in back surface 32 of first external retainer 30. The ash-containing vessel 40 may be formed of two separate members that are welded/soldered together if metal or secured via adhesive or other chemical bonding, if plastic. This two-part system encompasses the possibility that the second element is a cork/plug that is glued into an opening through which the ashes have been inserted by the crematorium.

Figure 3:
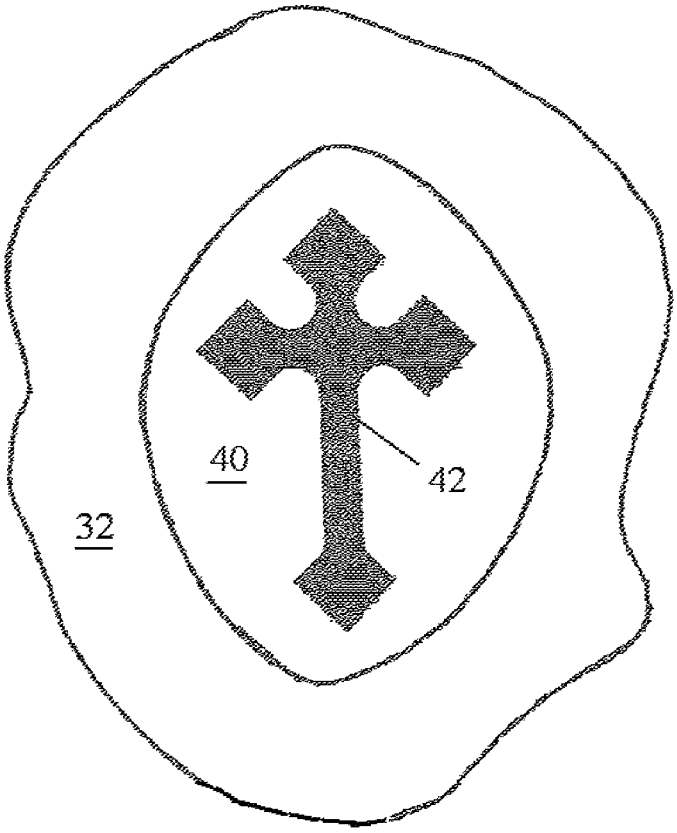
FIG. 3 is a rear view of the memorial urn bearing a second configuration of religious symbol
Figure 4:
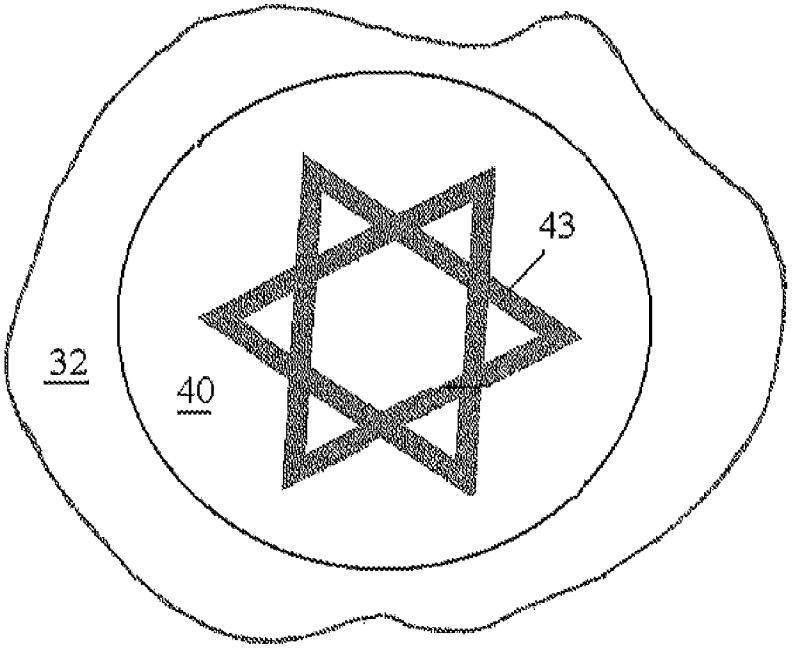
FIG. 4 is a rear view of the memorial urn depicting a round ash-containing vessel bearing a third configuration of religious symbol.
Figure 5:
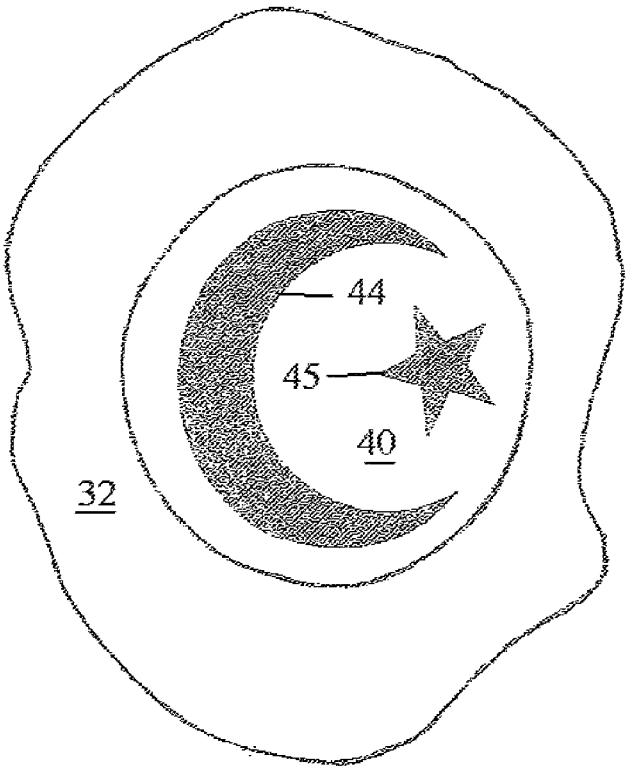
FIG. 5 is a rear view of the memorial urn bearing a fourth configuration of religious symbol.
Figure 6:
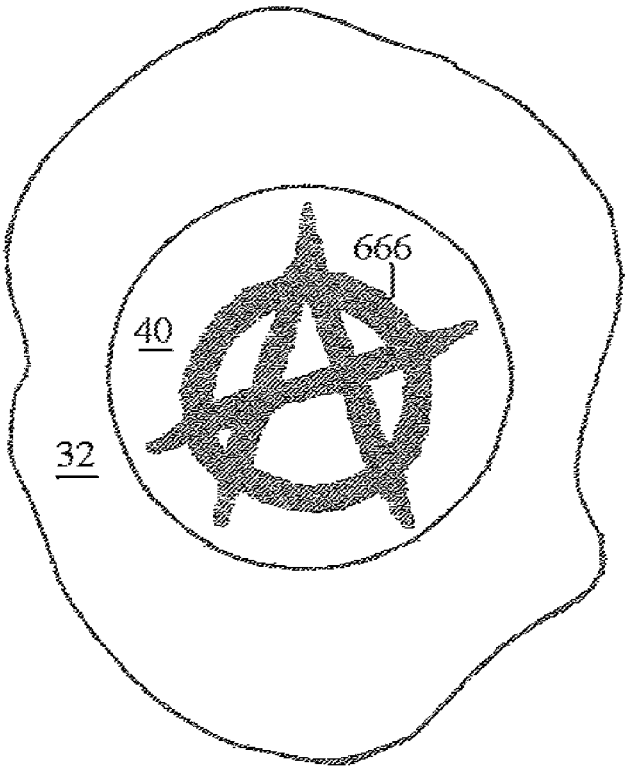
FIG. 6 is a rear view of the memorial urn bearing a fifth configuration of religious symbol.
Figure 7:
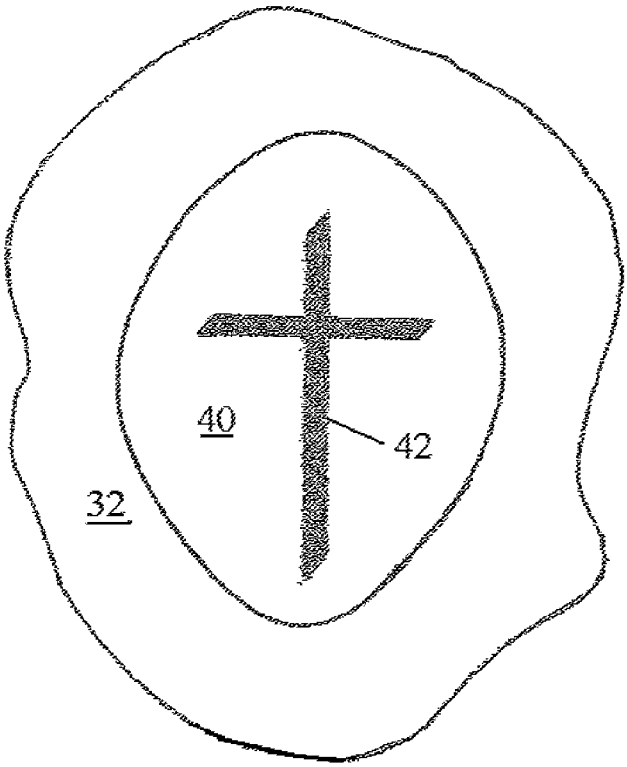
FIG. 7 is a rear view of the memorial urn bearing a sixth configuration of religious symbol.

Just as the first external retainer 30 can be customized to have whatever outer appearance (as well as internal cavity shape) the purchaser desires, the second ash-containing vessel 40 can be tailored to suit the desires of the individual, as well. FIGS. 2-8 depict several of the various options; however, actual configurations/appearances are limited only by the imaginations of the buyers. FIG. 2 shows an ovoid or egg-shaped vessel 40 with a conventional cross 42 painted/etched on the front face thereof. FIG. 3 depicts a egg-shaped vessel 12 with a stylized cross 42 painted/etched thereon. FIG. 4 depicts a round vessel 40 with a star of David 43 etched/painted thereon. FIG. 5 shows a round vessel 40 with the star 45 and crescent 44 of the Muslim faith. FIG. 6 depicts a round vessel 40 with an atheist symbol 666 etched/painted thereon. FIG. 7 shows an ovoid vessel 40 with a stylized cross 46 painted/etched thereon. It will be understood that these are simply examples and are not meant to limit the possibilities available with the present system. FIG. 8 depicts the preferred embodiment in which the ash-containing vessel 40 is formed in the shape of a cross and, as discussed supra, is held in by a pair of extending fingers 52 and spring finger 54, enabling the ash-containing vessel 40 to be easily removed from the external retainer 30. The outermost surface of the ash-containing vessel 40 is flush with or below the flat surface 32 so as not to interfere with the memorial urn being mounted on a flat surface. The mounting could be done with a conventional picture-hanger or, secured with more permanent fasteners, should possible tampering be an issue as when securing to a headstone in a cemetery.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A memorial urn for storing ashes of a loved one comprising:

a) a first external retainer depicting a featured reminder of the loved one, said first external retainer being an unitary member and having a front surface formed as a non-planar, 3-D representation of the reminder of the loved one and having an opposing flat rear surface allowing its mounting on one of a wall and a headstone, said flat rear surface having a recess formed therein;

b) a second separable ash-containing vessel configured as a religious symbol, said ash-retaining vessel having a sealable compartment for retaining the ashes of the loved one therein;

c) attachment means for removably securing said second ash-containing vessel into said recess formed in said flat rear surface, said attachment means including a first connector associated with said first external retainer and a second connector associated with said second ash-containing vessel, said first and said second connectors interacting to removably secure said second ash-containing vessel in said recess in said first external retainer.

2. The memorial urn of claim 1 wherein a distal-most surface of said second ash-containing vessel occupies a common plane with said rear flat surface of said first external retainer whereby said second ash-containing vessel is entirely contained within an outer boundary of said first external retainer.

3. The memorial urn of claim 1 wherein said non-planar, 3-D representation is a model of a front portion of the loved one.

4. The memorial urn of claim 3 wherein said front portion of the loved one comprises a facial portion of the loved one from her/his ears forward and from the neck up.

5. The memorial urn of claim 1 wherein said recess comprises an opening having a first shape which is complementary to a second shape of said ash-containing vessel.

6. The memorial urn of claim 1 wherein the religious symbol of said second ash-containing vessel is selected from a group consisting of a cross, an egg, a geometric shape bearing religious indicia, and a star of David.

7. The memorial urn of claim 1 wherein said first connector comprises an extending lip and said second connector includes at least one extending finger for engaging a first portion of said extending lip and a spring finger releasably engaging a second portion of said extending lip.

8. A memorial urn for storing ashes of a loved one, said memorial urn comprising:

a) a first unitary external retainer depicting a featured reminder of the loved one, said first external retainer having a front surface formed as a non-planar, three-dimensional representation of a facial portion of the loved one and having an opposing flat rear surface allowing its mounting on one of a wall and a headstone, said flat rear surface having a recess formed therein wherein said recess is formed as a cross;

b) a second ash-containing vessel configured as a cross, said ash-containing vessel having a sealable compartment for retaining the ashes of the loved one therein;

c) attachment means for removably securing said second ash-containing vessel configured as a cross into said recess formed as a cross in said flat rear surface, said attachment means including a first connector associated with said first external retainer and a second connector associated with said second ash-containing vessel, said first and said second connectors interacting to removably secure said second ash-containing vessel formed as a cross in said recess formed as a cross in said first external retainer.

* * * * *